United States Patent [19]

Vuyovich

[11] 4,070,792

[45] Jan. 31, 1978

[54] GAME DEVICE FOR LAUNCHING AND PUSHING A ROLLING WHEEL

[76] Inventor: John M. Vuyovich, 1369 McDuff St., Los Angeles, Calif. 90026

[21] Appl. No.: 678,864

[22] Filed: Apr. 21, 1976

[51] Int. Cl.[2] ..... A63H 33/02

[52] U.S. Cl. ..... 46/220

[58] Field of Search ..... 46/220

[56] References Cited

U.S. PATENT DOCUMENTS

| | | | |
|---|---|---|---|
| 2,811,812 | 11/1957 | Bishop | 46/220 |
| 2,979,860 | 4/1961 | Barta | 46/220 |
| 3,401,484 | 9/1968 | Anslover | 46/220 |
| 3,413,755 | 12/1968 | Mishler | 46/220 |
| 3,464,155 | 9/1969 | Capalia et al. | 46/220 |
| 3,820,484 | 6/1974 | Beaver | 46/220 |

*Primary Examiner*—Louis G. Mancene
*Assistant Examiner*—Robert F. Cutting

[57] ABSTRACT

This invention relates to a toy for active children. It consists of four major parts: a grooved handle, a housing unit resembling a chute, a roller or dowel and a small wheel or disc approximately eight inches in diameter. The wheel or disc and its function, become the principle object of this related toy. The wheel is without attachments and is separately set in revolving motion on the ground, as later described in the preferred embodiment. With the remaining major parts assembled, this device is brought to use grip in hand at the rear of the revolving wheel, simultaneously roller or dowel is brought in contact with rim of revolving wheel. When such contract is made, a constant pressure in nudging fashion is maintained at this point, thus forcing wheel to continue revolving forward along a selected route.

Guide panels of former mentioned chute aid in guiding and balancing the wheel in its forward revolving motion, while participant increases or decreases rate of pace. Maintaining wheel in balance and continually revolving forward without faltering, reflects the skill of the participants.

4 Claims, 3 Drawing Figures

GAME DEVICE FOR LAUNCHING AND PUSHING A ROLLING WHEEL

BRIEF SUMMARY OF THE INVENTION

The primary object of this invention is to provide a device wherewith active children can expend their energies in competitive action, with excitement and pleasure, with remote possibility of any injuries. Manipulating this device in the described proper manner, guiding revolving wheel on the ground in forward balanced motion, will be a challenge enjoyed. In competition, the participant who continues to control the wheel revolving forward in balance, for the longest distance, is judged the most successful.

Another object of this invention is to provide a lightweight, easily manipulated device, which could accompany and entertain the physical fitness enthusiasts in their daily exercise routine or jogging. With this device or toy in hand and put to use in the described manner attention is diverted from time, distance and energies expended in the exercise, to the constant attention required to manipulate this device successfully in adherence to its design, thus, intermittently, pre-occupying the mind.

This invention is illustrated in a preferred embodiment by the accompanying drawings in which.

Figure 1:
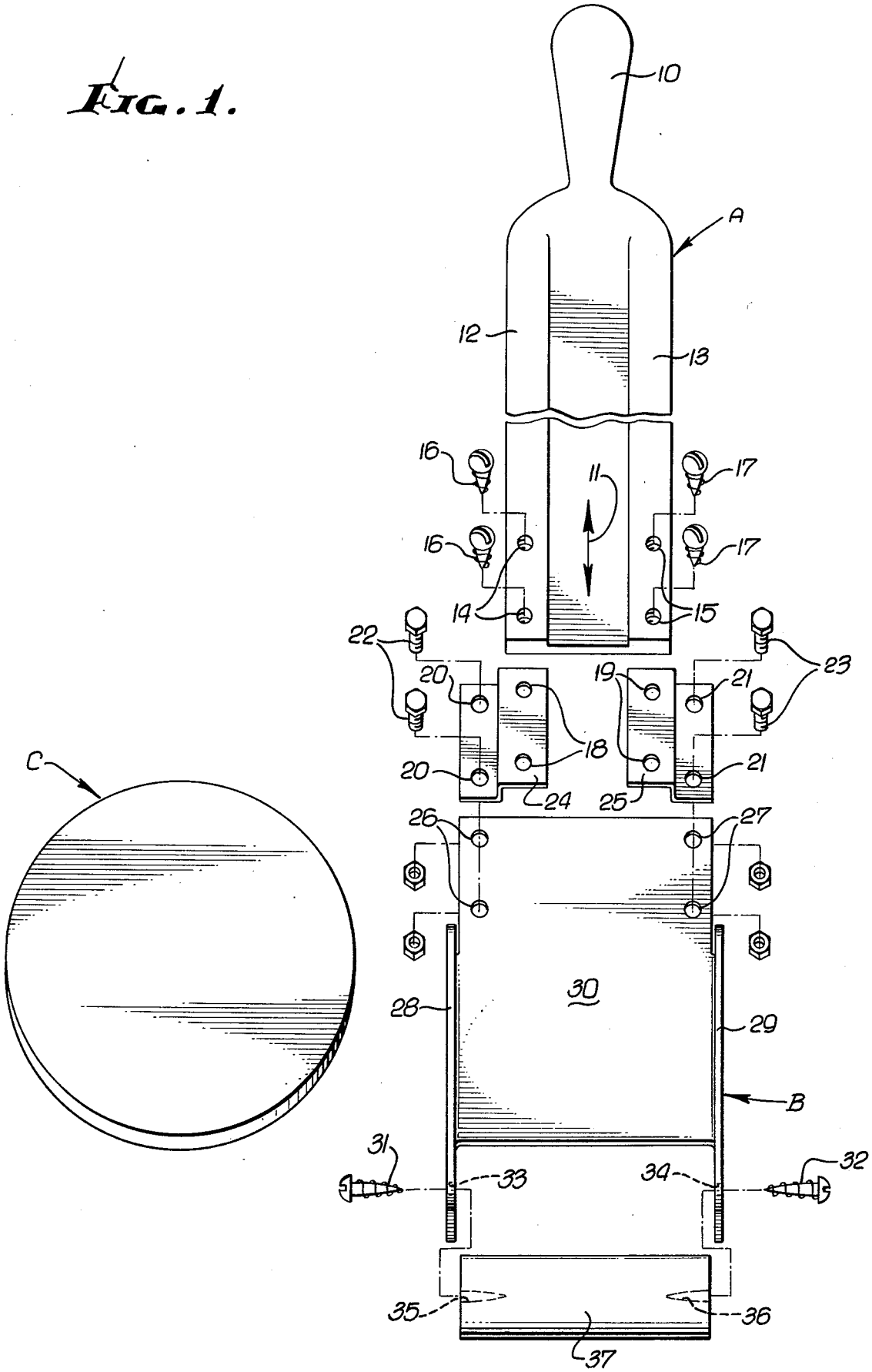
FIG. 1 is a broken vertical sectional view showing a device embodying my invention.

In the illustration given A designates a grooved handle; B a housing unit or chute with roller or dowel; C a wheel or disc.

PREFERRED EMBODIMENT

The grooved handle A may be constructed of any suitable material preferably, lightweight aluminum, durable plastic or wood. A groove 11 has been carved in handle A for the sole purpose of controlling wheel C from sideslipping off of handle A when wheel C is set in motion at the initial phase of the operation of this toy. In the illustration given, groove 11 extends from the base of grip 10 throughout the length of handle A. The width of said groove 11 is half the thickness of handle A, thus enabling wheel C to revolve freely in groove 11 when wheel C is set in motion as later described in the preferred embodiment.

Grooved handle A is attached and held fast to housing unit or chute B by two figure Z clamplike objects 24 and 25. In the following preferred embodiment objects 24 and 25 have been labeled Z clamps because it is the sole and exact purpose of their construction; to clamp down tightly handle A to housing unit B at entrance of ramp 30. To clarify further; the letter Z has been selected to denote, as closely as possible, the exact form and outline of objects 24 and 25.

Said clamps 24 and 25 are attached to housing unit B by placing Z clamp 24 with holes 20, aligned atop holes 26 of housing unit B at entrance ramp 30; likewise Z clamp 25 with holes 21 is placed aligned, atop holes 27 of housing unit B at entrance ramp 30. With Z clamps in this position, measured bolts or rivets are placed through said aligned holes, securing clamps 24 and 25 tightly to housing unit B entrance ramp 30.

Z clamps 24 and 25 secured in this position will form a slot measuring the width and thickness of handle A. Handle A is inserted in this slot at point where holes 14 and 15 have been punctured in ledges 12 and 13 respectively. These punctures 14 and 15 at the opposite end of grip 10 of handle A are brought directly in line, from within slot, with matching Z clamp holes 18 and 19 respectively. Measured size screws 16 and 17 are placed in said aligned holes as illustrated, securing handle A to Z clamps 24 and 25, thus securing handle A to housing unit B entrance ramp 30.

Figure 2:
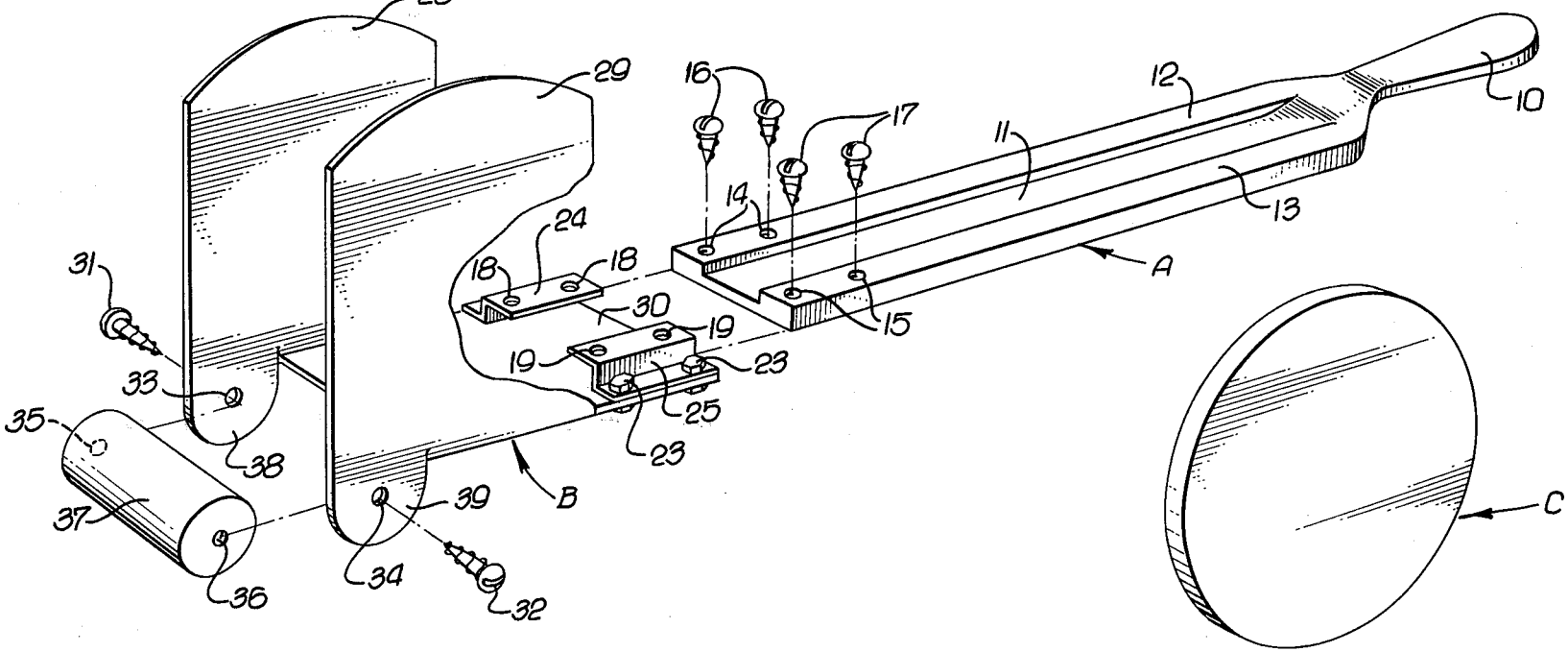
FIG. 2 is an enlarged profile sectional view of device and accompanying wheel or disc.

Housing unit B can be constructed of any suitable light-weight durable material, preferably lightweight aluminum or durable plastics one-eighth inch in thickness, bent or molded forming right angled panels 28 and 29 as they appear in FIG. 2 drawing. These panels are labeled guide panels because of their function as described immediately following. Space of four inches is allowed between guide panels 28 and 29 to allow wheel C to sidle, while it revolves on the ground guided on a straight course between the two panels 28 and 29, thereby granting maneuvering space creating a better opportunity for balancing and guiding wheel C in its forward revolving motion.

Figure 3:
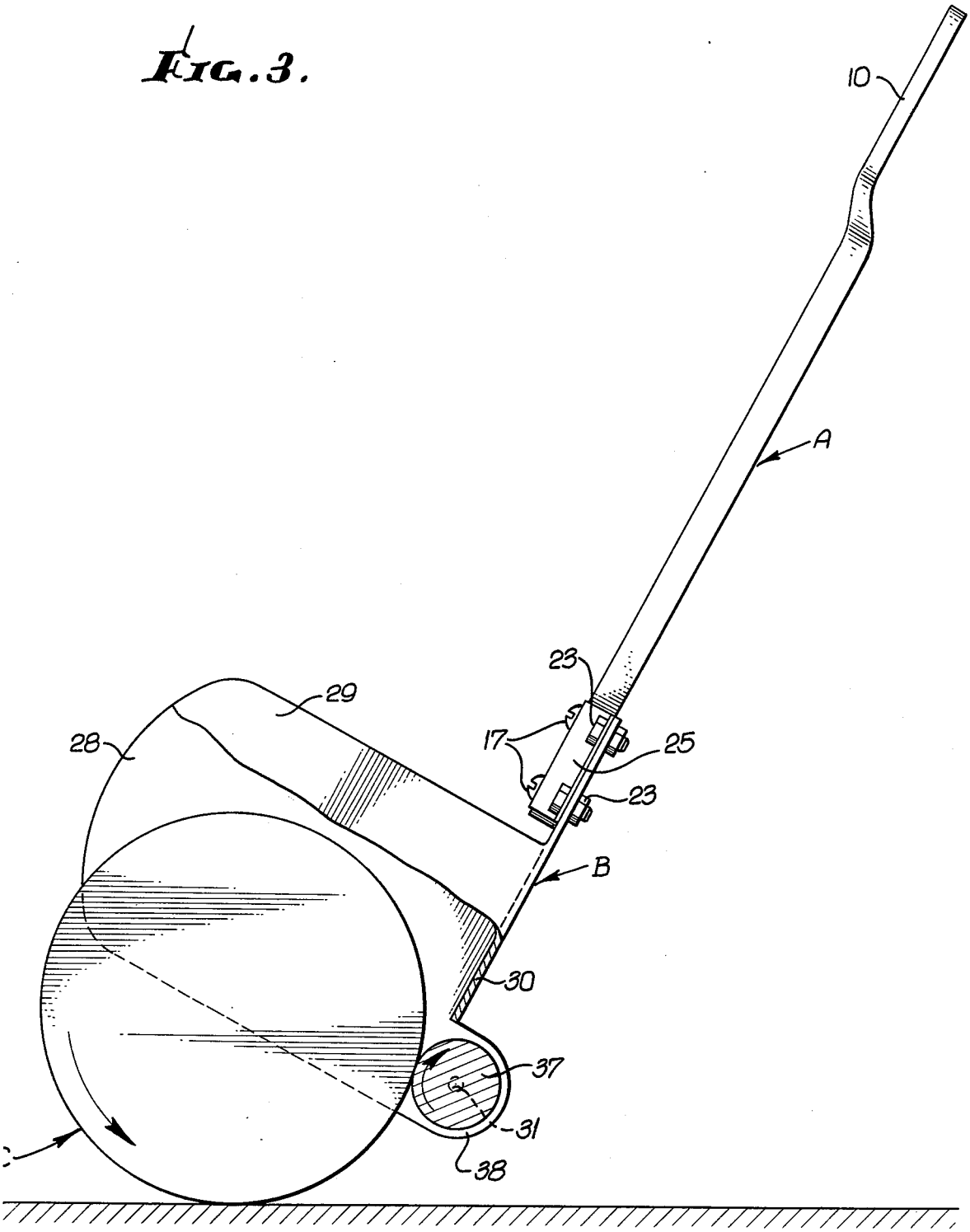
FIG. 3 is a oblique outline of device showing wheel or disc in contact with roller, thus exemplifying their proper position when device is put to use.

The roller or dowel 37 may be constructed of any suitable material such as lightweight aluminum, durable plastics or wood. Roller 37 is installed at the exit of chute B fitting in between guide panels 28 and 29 at extended points of two lobes 38 and 39 on either side of chute B. Said lobes also act as bushings for screws 31 and 32. The two lobes 38 and 39 are indented away from the exit point of ramp 30 chute B, as illustrated in FIG. 2 drawing, for the purpose of drawing roller 37 away from exit of chute B so as not to obstruct the route of wheel C as it traverses chute B, when initially set in motion, as later described in the preferred embodiment. Roller 37 is held in its designated position by two screws 31 and 32 which also act as axles when inserted through holes 33 and 34 of related lobes, then secured in related holes 35 and 36 of roller 37. A roller 37 is preferred with this device, instead of a stationary dowel, thus eliminating friction at contact point of roller 37 and rim of wheel C during the revolving process of said wheel as illustrated in FIG. 3 drawing. Roller 37 will revolve on axle screws 31 and 32 in related holes 33 and 34 when contact is made with wheel C, thus acting in the support of the revolving process of wheel C. The assembled device or toy is held vertically in one hand at grip 10, slightly tilted at an oblique angle with roller 37 grazing the ground, as illustrated in FIG. 3 drawing. Wheel C held in the free hand, is placed in an upright for revolving position, in groove 11 at base of grip 10. With device and said wheel in this starting position, a slight nudge of said wheel, in a downward revolving motion, is sufficient to initiate the required momentum, setting wheel C in a forward revolving motion, traversing handle A while restricted to groove 11.

In its downward motion wheel C will exit handle A at Z clamps connection, traverse entrance ramp 30, hence entering housing unit chute B between guide panels 28 and 29; in its continued downward revolving motion said wheel will exit chute B, crossing over roller 37, then on to the ground. Immediately, device is brought in use, held in the same position as at the initial revolving start of wheel C; Roller 37, assembled to device, is brought in contact with rim of wheel C, continually nudging said wheel in a revolving forward motion on the ground. From this point on, the ability to maintain wheel C in a balanced forward revolving motion, by nudging said wheel at contact point with roller 37 and by keeping said wheel in balance with the aid of guide panels 28 and 29, will be a test of skill for all participants involved with this toy. This toy can be handled with safety and with ease and requires no maintenance.

While in the foregoing description, I have set forth a specific construction as an illustration of the principles of my invention, it will be understood that variations may be made therefrom without departing from the spirit of my invention. The foregoing detailed description has been given for clearness of understanding only, and no unnecessary limitations should be understood therefrom, but the appended claim should be construed as broadly as permissible, in view of the prior art.

I claim:

1. A game device for use with a disk-shaped object comprising the combination of an elongated member having a portion at one end thereof adapted to be held by hand and a groove extending along part of the length of the member between said portion and the other end thereof, said groove being configured to permit a disk-shaped object to roll along the length thereof, a pair of panels mounted on the member at said other end thereof and on opposite sides of the groove, said panels being parallel and spaced apart from each other by a distance greater than the width of a disk-shaped object with which the game device is used, the panels being operative to guide the disk-shaped object when the object is rolled along the length of the elongated member and to engage the sides of the object to turn the object after launching from the elongated member and when rolling along the ground, and a roller extending between and rotatably mounted on the flanges and operative to engage and rotate with a disk-shaped object with which the game device is used when the object is received between the panels.

2. The invention set forth in claim 1, further comprising a disk-shaped object adapted to roll on edge along the groove in the member.

3. A game device for use with a circular object comprising the combination of an elongated member having a portion at one end thereof adapted to be held by hand and a groove extending along part of the length of the member between said portion and the other end thereof, said groove being configured to permit a circular object to roll along the length thereof, a roller rotatably mounted on the member adjacent said other end thereof, and a pair of panels mounted on the member at said other end thereof and on opposite sides of the groove, the member being generally straight along the length thereof, the roller comprising a generally cylindrical element disposed away from the path of the groove and mounted for rotation about an axis which is generally transverse to the direction of elongation of the member, the panels comprising relatively thin, generally planar elements mounted in generally parallel, spaced-apart relation to one another and extending outwardly from the member, the elongated member being comprised of an elongated handle having said portion adapted to be held by hand at one end thereof and said groove extending along the length thereof between said portion and the other end of the handle, and a generally flat ramp coupled to the second end of the handle.

4. The invention set forth in claim 3, wherein the ramp comprises a relatively thin, generally planar element extending between and joining the panels, the second end of the handle is mounted on an end of the ramp opposite the roller by an opposite pair of Z-shaped brackets, and each of the panels has a lobe extending therefrom and rotatably mounting one end of the roller.

* * * * *